United States Patent [19]

Bryan

[11] Patent Number: 4,953,781

[45] Date of Patent: Sep. 4, 1990

[54] CLOSURE FOR A CONTAINER

[76] Inventor: William T. Bryan, 927 Garnoa Dr., Springfield Township, Hamilton County, Ohio 45231

[21] Appl. No.: 222,850

[22] Filed: Jul. 22, 1988

[51] Int. Cl.[5] ..... B65D 17/28; B65D 5/74

[52] U.S. Cl. ..... 229/125.11; 229/123.2; 229/125.04; 229/125.08; 206/621.4; 206/621.6

[58] Field of Search ..... 229/125.11, 125.42, 229/123.01, 123.02, 125.04, 125.08; 206/621.4, 621.6, 626, 631.2, 621.6; 222/528, 531, 532

[56] References Cited

U.S. PATENT DOCUMENTS

| | | | |
|---|---|---|---|
| 1,698,338 | 1/1929 | Lewin | 222/528 |
| 1,712,249 | 5/1929 | Byrne | 206/626 X |
| 2,010,972 | 8/1935 | Weiss | 206/626 |
| 2,077,341 | 4/1937 | Martin et al. | 229/123.2 |
| 2,105,547 | 1/1938 | Mergentheim | 206/626 X |
| 2,288,042 | 6/1942 | Spilman | 229/125.04 X |
| 2,546,052 | 3/1951 | Wilkins | 229/125.42 X |
| 2,701,679 | 2/1955 | Goldstein | 206/621.4 |
| 2,736,484 | 2/1956 | Vines | 206/633 |
| 2,757,830 | 8/1956 | Hansen | 222/528 |
| 2,907,512 | 10/1959 | Leone | 206/626 X |
| 2,909,310 | 10/1959 | Govang | 206/626 |
| 3,055,571 | 9/1962 | Hassler | 229/125.42 X |
| 3,147,907 | 9/1964 | Hartvig-Johansen | 206/625 |
| 3,292,839 | 12/1966 | Pike | 206/626 |
| 3,484,034 | 12/1969 | Sternau | 206/626 |

*Primary Examiner*—Stephen Marcus
*Assistant Examiner*—Jes F. Pascua
*Attorney, Agent, or Firm*—Roy F. Schaeperklaus

[57] ABSTRACT

A pour spout assembly for a container. A first tongue and a second tongue are formed in a wall of the container. The first tongue is defined by a transverse slit in the wall and downwardly extending slits in the wall at opposite ends of the transverse slit. The second tongue is defined by the transverse slit and by upwardly extending slits at opposite ends of the transverse slit. A central portion of a web member is attached to an inner face of the first tongue. The web member includes outer glue panels attached to the container wall and connected to the central portion by accordian pleat panels. The second tongue swings in response to contact with the central portion of the web as the central portion of the web passes it in moving between positions inside and outside the container as the first tongue swings between a closed position in which the first tongue is aligned with the wall and an upper section of the central portion of the web covers and closes the transverse slit and an open position in which the first tongue extends upwardly and outwardly from hinging means of the first tongue.

20 Claims, 3 Drawing Sheets

CLOSURE FOR A CONTAINER

BACKGROUND OF THE INVENTION

This invention relates to a closure for a container. More particularly, this invention relates to a reclosable pour spout for a container.

An object of this invention is to provide a closure structure for a container which may be in the form of a carton in which a tongue portion of a wall panel of the carton cooperates with a web attached to the tongue portion and to the wall panel adjacent the tongue portion to form the closure.

A further object of this invention is to provide such a closure structure including pleated web portions which can move between a locked open position and a closed position.

Folded web closures for spouts are shown in patents such as Lewin U.S. Pat. Nos. 1,698,338, Marken 2,444,104, Hansen 2,757,830, Petitto b 3,154,226, and Kurtz 3,250,436. However, the structures are entirely different.

BRIEF STATEMENT OF THE INVENTION

Briefly, this invention provides a carton having a reclosable pour spout provided in a side panel thereof. The side panel is provided with slots which define opposed tongues which are hinged to have adjoining free edges. A central portion of a closure web overlies and is attached to an inner face of one of the tongues, and a free edge portion of the web overlies an adjacent part of the opposed tongue, but is not attached to the latter. Free edges of said central portion of the web are connected to outer glue panels by accordian pleats. The glue panels are attached to the inner face of the side panel. A free edge portion of the web can snap between a position inside of the box overlying the inward face of the other tongue at which a closure is formed, and a position outside the other tongue at which the closure is open.

The above and other objects and features of the invention will be apparent to those skilled in the art to which this invention pertains from the following detailed description and the drawings, in which:

BRIEF DESCRIPTION OF THE DRAWINGS

In the following detailed description and the drawings, like reference characters indicate like parts.

DESCRIPTION OF PRESENTLY PREFERRED EMBODIMENT

Figure 1:
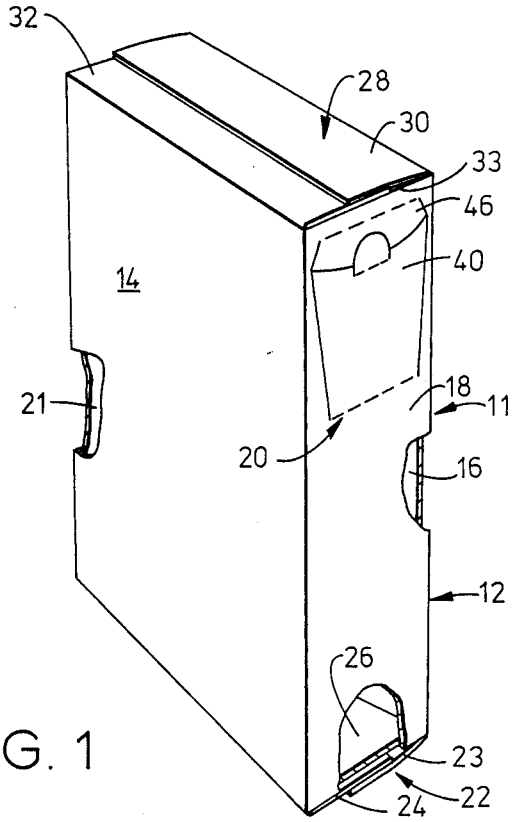
FIG. 1 is a perspective view of a carton which includes a closure spout constructed in accordance with an embodiment of this invention, hinge lines being shown by dashed lines, portions of the carton being broken away to show details of construction.
Figure 2:
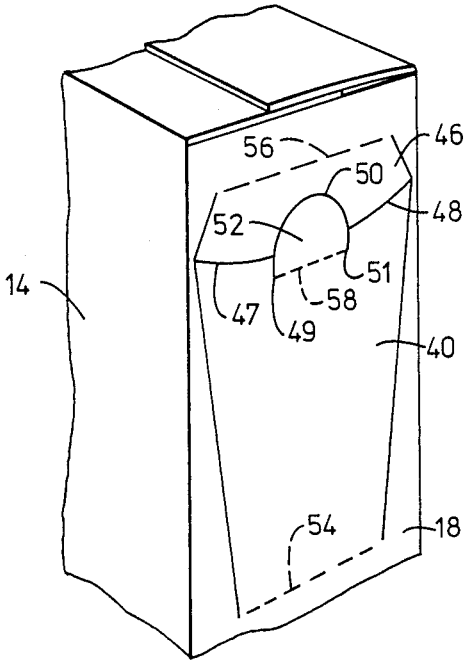
FIG. 2 is an enlarged perspective view of the portion of the carton which carries the closure.

In FIG. 1 is shown a cardboard carton 11 constructed in accordance with an embodiment of this invention. The carton 11 includes a body 12, which can be generally of the form of a box for particulate material or the like. The carton 11 includes a front panel 14, a rear panel 16, which can be similar in form to the front panel, a first flat side panel 18, which carries a closure and spout assembly 20, and a second side panel 21, which can be generally similar to the first side panel but does not carry any closure assembly. A bottom assembly 22 includes major flanges 23 and 24 hinged to the rear panel 16 and the front panel 14, respectively, and minor flaps 26, only one of which is shown. A top assembly 28 includes major flaps 30 and 32 and minor flaps 33, only one of which is shown.

Figure 3:
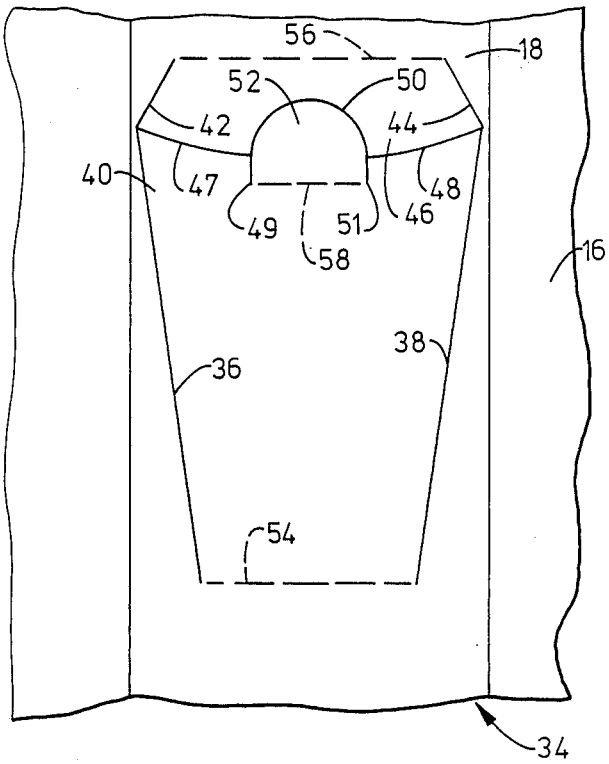
FIG. 3 is a fragmentary elevated view of a blank for the carton in flattened position.

The first side panel 18 is part of a blank 34, only a portion of which is shown in FIG. 3. Slits 36 and 38 separate the side edges of a main tongue 40 from the rest of the blank 34. Slits 42 and 44 separate the side edges of a short upper tongue 46 from the rest of the blank 34. A curved central slit 50 extends from end 49 to end 51 and separates the curved edge of tab 52 from contiguous parts of tongues 40 and 46. Cross slit segments 47 and 48 separate the ends of tongues 40 and 46 laterally of tab 52. The tongues 40 and 46 are provided with lines of weakening 54 and 56, respectively, which permit swinging of the tongues. The tab 52 is provided with a line of weakening 58 which permits swinging of the tab 52. The slits 36 and 38 extend downwardly from end portions of the cross slit segments 47 and 48. The slits 42 and 44 extend upwardly from end portions of the cross slit segments 47 and 48.

Figure 4:
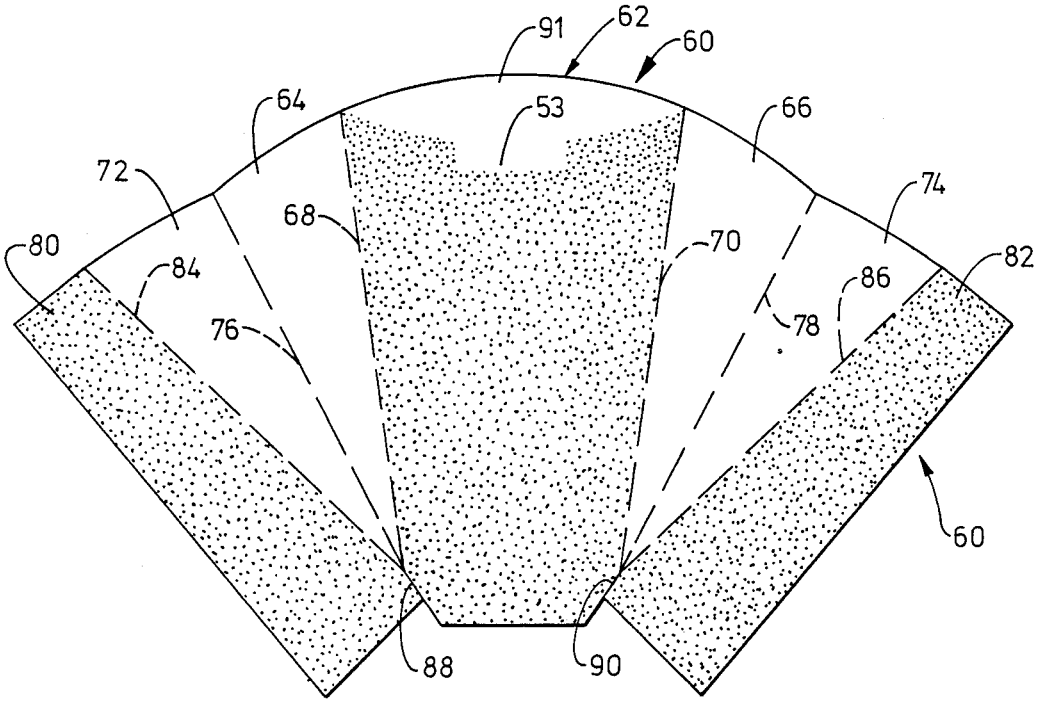
FIG. 4 is a plan view of a web member of the carton, glue coated portions being shown in stippling, fold lines being shown in dashed lines.
Figure 5:
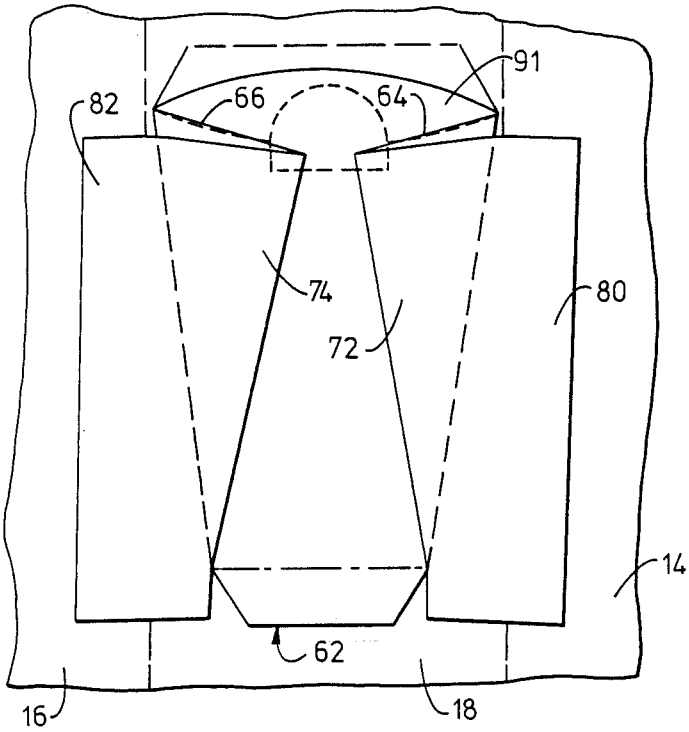
FIG. 5 is a fragmentary view of the carton blank and the web in attached position, hidden fold lines being shown in dotdash lines.

The closure and spout assembly 20 is completed by a web member 60 (FIG. 4). The web member 60 includes a central panel 62, inner generally triangular first and second pleat panels 64 and 66 hinged to the central panel 62 along lines of fold 68 and 70, respectively, outer generally triangular third and fourth pleat panels 72 and 74, which are hinged to the first and second pleat panels at fold lines 76 and 78, respectively, and first and second glue panels 80 and 82, which are hinged to the third and fourth pleat panels 72 and 74 along fold lines 84 and 86, respectively. As indicated by stippling in FIG. 4, the first and second glue panels 80 and 82 and a major portion of the central panel 62 are provided with adhesive outer faces. As shown in FIG. 5, the first and third pleat panels 64 and 72 are folded together and the second and fourth pleat panels 66 and 74 are folded together. Slits 88 and 90 are formed in the web member 60 to permit folding thereof. The inner face of the main tongue 40 is attached to the central panel 62 of the web member 60 by means of the adhesive on the central panel 62, byt not to the inner face of tab 52, adhesive being omitted from the area 53 of panel 62. The glue panels 80 and 82 are attached to underlying portions of the first side panel 18 and to the front panel 14 and the rear panel 16, respectively.

Figure 9:
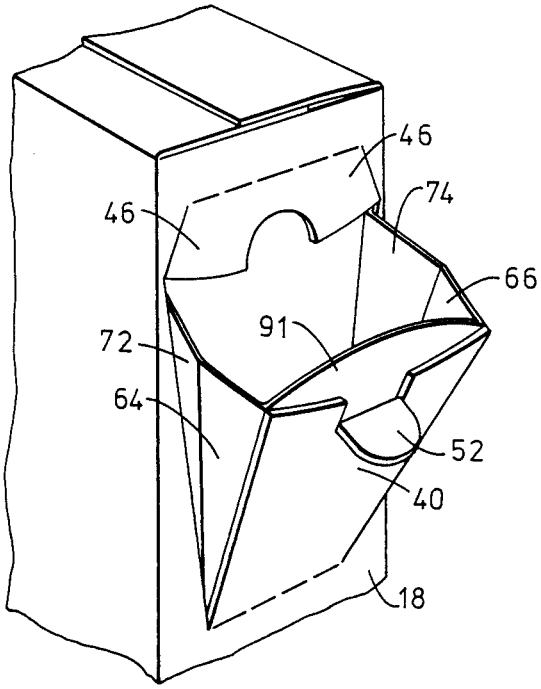
FIG. 9 is a perspective view of of the closure portion of the carton in open, locked position.
Figure 6:
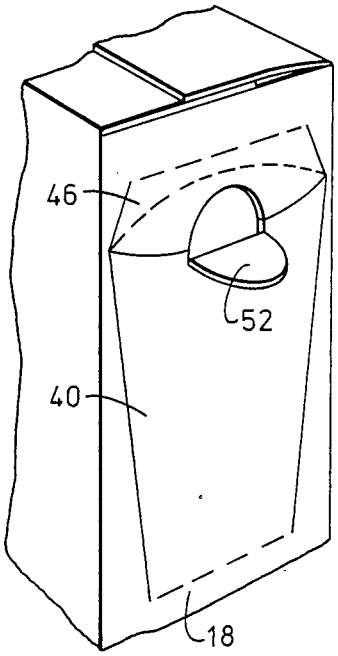
FIG. 6 is a fragmentary perspective view of the carton, a tab member being shown in extended position.
Figure 7:
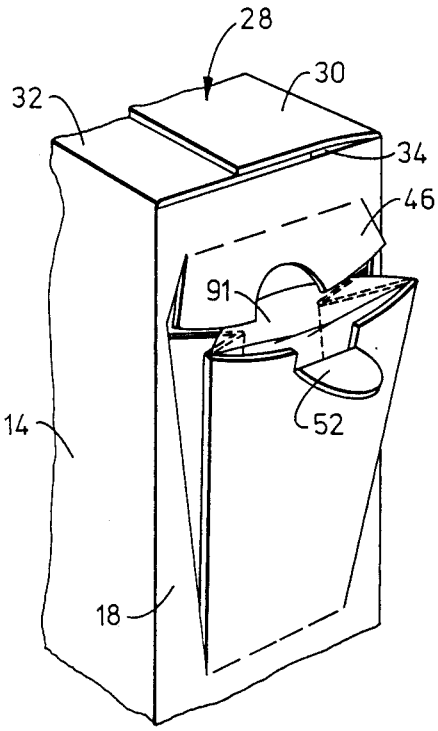
FIG. 7 is a fragmentary perspective view of the closure portion of the carton in partly open position.
Figure 8:
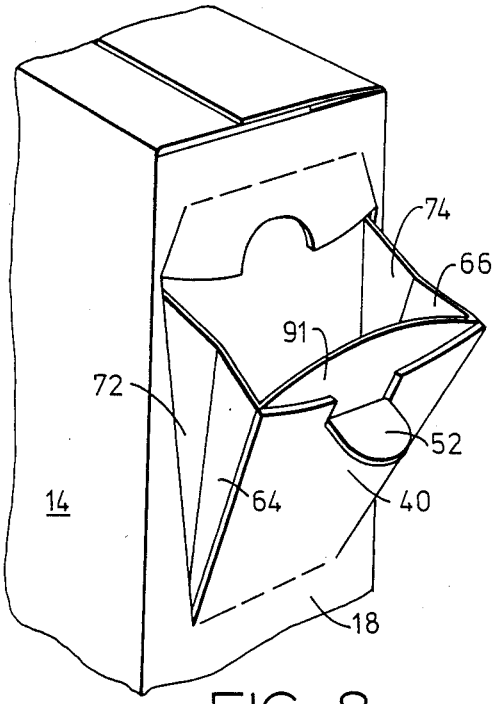
FIG. 8 is a perspective view of the closure portion of the carton with the closure in fully open but unlocked position.

The tab 52 can be swung out as shown in FIG. 6 and can be pulled outwardly of the carton 11 to cause an upper end portion 91 of the central panel 62 to push the short upper tongue 46 to swing outward and upward, out of the way as shown in FIG. 7 as the pleat panels open. The pleat panels can be opened to fully open position as shown in FIG. 8. Finally, pairs of pleat panels 64–72 and 66–74 can be swung apart as shown in FIG. 9 to a locked position.

Figure 10:
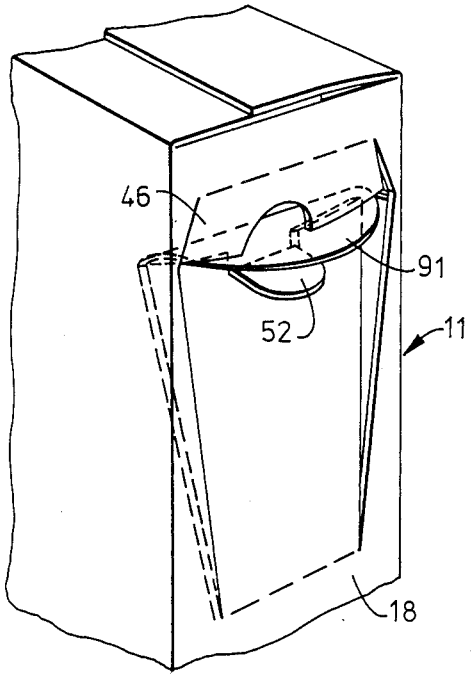
FIG. 10 is a perspective view of the closure portion of the carton in partly closed position.

When the closure assembly 20 is to be closed, the pairs of pleat panels 64–72 and 66–74 are returned to the position of FIG. 8. Tab 52 is pushed inwardly to bring the upper end portion 91 of the central panel 62 to bear against the tongue 46 to push the latter and the tongue 40 inwardly of the carton 11, as shown in FIG. 10. The tongue 46 is swung inwardly and upwardly as the upper end portion 91 folds downwardly as it passes beneath the lower edge of tongue 46 and then springs upward when it is inside of the box and behind the tongue 46 to bring the carton back to the FIG. 6 position at which the upper end portion 91 underlies and closes the cross slit 47–48 and bridgingly closes the opening left by forming of tongue 52. The tab 52 can then be folded into alignment with the first side panel 18 for storage in the FIG. 1 position.

While slits 36, 38, 42, 44, 47, 48 and 50 referred to in the foregoing description are each shown in the drawings as continuous and extending through the container wall from end-to-end of the slit, the slits may be in the form of perforations or other wall weakening alterations of the wall so the consumer may complete the slits, viz., by tearing, to open the carton and place it in condition for operation of the closure-spout.

The container-carton closure construction illustrated in the drawings and described above is subject to structural modification without departing from the spirit and scope of the appended claims.

Having described my invention, what I claim as new and desire to secure by letters patent is:

1. A pour spout assembly for a container having a wall which comprises a first tongue formed from the wall and hinged to the wall and a second tongue formed from the wall and hinged to the wall, the first tongue being defined by a transverse slit in said wall and downwardly extending upright slits in said wall at opposite ends of the transverse slit, the first tongue being hinged to the wall at lower ends of the upright slits, the second tongue being defined by said transverse slit and by upwardly extending slits at opposite ends of the transverse slit, the second tongue being hinged to the wall at upper ends of the upright slit of the second tongue, and a web member a central portion attached to an inner face of the first tongue, outer glue panels attached to an inner face of the container adjacent the first tongue, and accordian pleat panels connecting the central portion and the outer glue panels, free edges of the central panel of the web being hinged to the accordian pleat panels, outer edges of the accordian pleat panels being hinged to the glue panels, the first tongue swinging between a closed position in which the first tongue is aligned with the wall and an upper portion of the central portion of the web overlaps a portion of the inward face of the second tongue and covers and closes the transverse slit and an open position in which the first tongue extends upwardly and outwardly from hinging means of the first tongue.

2. A pour spout assembly as in claim 1 in which the accordian pleat panels of the web, when open, can be swung between an inner position at which the first tongue can be closed and an outer position in which the pleat panels lock in open position.

3. A pour spout assembly as in claim 1 which includes a tab hinged to the first tongue and the tab can swing between a closed position aligned with the panel and a raised position extending outwardly from the first tongue for use in closing and opening the pour spout.

4. A pour spout assembly for a carton having a panel which comprises a first tongue formed from the panel and hinged to the panel and a second tongue formed from the panel and hinged to the panel, the first tongue being defined by a transverse slit in said panel and downwardly extending upright slits in said panel at opposite ends of the transverse slit, the first tongue being hinged to the panel at lower ends of the upright slits, the second tongue being defined by said transverse slit and by upwardly extending slits at opposite ends of the transverse slit, the second tongue being hinged to the panel at upper ends of the upright slits of the second tongue, and a web member having a central portion attached to an inner face of the first tongue, outer glue panels attached to an inner face of the carton adjacent the first tongue, and accordian pleat panels connecting the central portion and the outer glue panels, free edges of the central panel of the web being hinged to the accordian pleat panels, outer edges of the accordian pleat panels being hinged to the glue panels, the first tongue swinging between a closed position in which the first tongue is aligned with the panel and an upper portion of the central portion of the web overlaps a portion of the inward face of the second tongue and covers and closes the transverse slit and an open position in which the first tongue extends upwardly and outwardly from hinging means of the first tongue.

5. A pour spout assembly as in claim 4 in which the accordian pleat panels of the web, when open, can be swung between an inner position at which the first tongue can be closed and an outer position in which the pleat panels lock in open position.

6. A pour spout assembly as in claim 4 which includes a tab hinged to the first tongue and the tab can swing between a closed position aligned with the panel and a raised position extending outwardly from the first tongue for use in closing and opening the pour spout.

7. A pour spout assembly for a carton having a side panel which comprises a first tongue formed from the side panel and hinged to the side panel and a second tongue formed from the side panel and hinged to the side panel, the first tongue being defined by a transverse slit in said flat side panel and downwardly extending slits in said side panel at opposite ends of the transverse slit, the first tongue being hinged at lower ends of the slits, the second tongue being defined by said transverse slit and by upwardly extending slits at opposite ends of the transverse slit, the second tongue being hinged at upper ends of the slits of the second tongue, and a web member having a central portion attached to an inner face of the first tongue, outer glue panels attached to an inner face of the side panel, and connecting panels joining the central portion and the outer glue panels, free edges of the central panel of the web being hinged to the glue panels, the first tongue swinging between a closed position in which the first tongue is aligned with the side panel and an upper section of the central portion of the web overlaps a portion of the inner face of the second tongue and covers and closes the transverse slit and an open position in which the first tongue extends upwardly and outwardly from hinging means of the first tongue.

8. A pour spout assembly as in claim 7 in which the connecting panels of the web are accordian pleated, and when the pour spout is open, can be swung between an inner position at which the first tongue can be closed and an outer position in which the connecting pleated panels lock in open position.

9. A pour spout assembly as in claim 7 which includes a tab hinged to the first tongue and the tab can swing between a closed position aligned with the panel and a raised position extending outwardly from the first tongue for use in closing and opening the pour spout.

10. A pour spout assembly for a container having a wall which comprises a tongue formed from the wall and hinged to the wall, the tongue being defined by a transverse slit in said wall and downwardly extending upright slits in said wall at opposite ends of the transverse slit, the tongue being hinged to the wall at lower ends of the upright slits, and a web member having a central portion attached to an inner face of the tongue, outer glue panels attached to an inner face of the container adjacent the tongue, and accordian pleat panels connecting the central portion and the outer glue panels, free edges of the central panel of the web being hinged to the accordian pleat panels, outer edges of the accordian pleat panels being hinged to the glue panels, the tongue swinging between a closed position in which the tongue is aligned with the wall and an upper portion of the central portion of the web overlaps a portion of the inward face of the wall and covers and closes the transverse slit and an open position in which the tongue extends upwardly and outwardly from hinging means of the tongue and from which open position the tongue is swung past the closed position to draw the upper portion of the central portion of the web into the box where it extends upwardly and engages the inward face of the wall as the tongue is drawn outwardly into alignment with the wall in closed position.

11. A pour spout assembly as in claim 10 in which the accordian pleat panels of the web, when open, can be swung between an inner position at which the tongue can be closed and an outer position in which the pleat panels lock in open position.

12. A pour spout assembly as in claim 10 which includes a tab hinged to the tongue and the tab can swing between a closed position aligned with the panel and a raised position extending outwardly from the tongue for use in closing and opening the pour spout.

13. A pour spout assembly for a carton having a panel which comprises a tongue formed from the panel and hinged to the panel, the tongue being defined by a transverse slit in said panel and downwardly extending upright slits in said panel at opposite ends of the transverse slit, the tongue being hinged to the panel at lower ends of the upright slits, and a web member having a central portion attached to an inner face of the tongue, outer glue panels attached to an inner face of the carton adjacent the tongue, and accordian pleat panels connecting the central portion and the outer glue panels, free edges of the central panel of the web being hinged to the accordian pleat panels, outer edges of the accordian pleat panels being hinged to the glue panels, the tongue swinging between a closed position in which the tongue is aligned with the panel and an upper portion of the central portion of the web overlaps a portion of the inward face of the panel and covers and closes the transverse slit and an open position in which the tongue extends upwardly and outwardly from hinging means of the tongue and from which open position the tongue is swung past the closed position to draw the upper portion of the central portion of the web into the box where it extends upwardly and engages the inward face of the panel as the tongue is draw outwardly into alignment with the panel in closed position.

14. A pour spout assembly as in claim 13 in which the accordian pleat panels of the web, when open, can be swung between an inner position at which the tongue can be closed and an outer position in which the pleat panels lock in open position.

15. A pour spout assembly as in claim 13 which includes a tab hinged to the tongue and the tab can swing between a closed position aligned with the panel and a raised position extending outwardly from the tongue for use in closing and opening the pour spout.

16. A pour spout assembly for a carton having a side panel which comprises a tongue formed from the side panel and hinged to the side panel, the tongue being defined by a transverse slit in said flat side panel and downwardly extending slits in said side panel at opposite ends of the transverse slit, the tongue being hinged at lower ends of the slits, and a web member having a central portion attached to an inner face of the tongue, outer glue panels attached to an inner face of the side panel, and connecting panels joining the central portion and the outer glue panels, free edges of the central panel of the web being hinged to the connecting panels, outer edges of the connecting panels being hinged to the glue panels, the tongue swinging between a closed position in which the tongue is aligned with the side panel and an upper section of the central portion of the web overlaps a portion of the inner face of the side panel and covers and closes the transverse slit and an open position in which the tongue extends upwardly and outwardly from hinging means of the tongue and from which open position the tongue is swung past the closed position to draw the upper portion of the central portion of the web into the box where it extends upwardly and engages the inward face of the side panel as the tongue is drawn outwardly into alignment with the side panel in closed position.

17. A pour spout assembly as in claim in which the connecting panels of the web are accordian pleated, and when the pout spout is open, can be swung between an inner position at which the tongue can be closed and an outer position in which the connecting panels lock in open position.

18. A pour spout assembly as in claim 16 which includes a tab hinged to the tongue and the tab can swing between a closed position aligned with the panel and a raised position extending outwardly from the tongue for use in closing and opening the pour spout.

19. A dispensing container having a wall, a tongue formed from the wall and hinged to the wall, the tongue being defined by a transverse line of weakening in said wall and downwardly extending upright lines of weakening in said wall at opposite ends of the transverse line of weakening, the tongue being hinged to the wall on a transverse hinge line at lower ends of the upright lines of weakening when the edges of the tongue are severed from the wall on the lines of weakening, a web member having a central portion attached to an inner face of the tongue, outer glue panels attached to an inner face of the container adjacent the upright edges of the tongue, and accordian pleat panels connecting the central portion and the outer glue panels, free edges of the central panel of the web being hinged to the accordian pleat panels, outer edges of the accordian pleat panels being hinged to the glue panels, the tongue swinging between a closed position in which the tongue is aligned with the wall and an upper portion of the central portion of the web overlaps a portion of the inward face of the wall and covers and closes the transverse slit and an open position in which the tongue extends upwardly and outwardly from hinging means of the tongue and the accordian pleat are fully extended and from which open position the tongue is swung past the closed position to draw the upper portion of the central portion of the web into the box where it extends upwardly and engages the inward face of the wall as the tongue is drawn outwardly into alignment with the wall in closed position.

20. A dispensing carton having a side panel, a tongue formed from the side panel and hinged to the side panel, the tongue defined by a transverse slit in said flat side panel and downwardly extending slits in said side panel at opposite ends of the transverse slit, the tongue being hinged on a transverse line at lower ends of the slits, and a web member having a central portion attached to an inner face of the tongue, outer glue panels attached to an inner face of the side panel laterally of the tongue, and connecting panels joining the central portion and the outer glue panels, free edges of the central panel of the web being hinged to the connecting panels, outer edges of the connecting panels being hinged to the glue panels, the tongue swinging between a closed position in which the tongue is aligned with the side panel and an upper section of the central portion of the web overlaps a portion of the face of the side panel and covers and closes the transverse slit and an open position in which the tongue extends upwardly and outwardly from hinging means of the tongue and the connecting panels are fully extended and from which open position the tongue is swung past the closed position to draw the upper portion of the central portion of the web into the box where it extends upwardly and engages the inward face of the side panel as the tongue is drawn outwardly into alignment with the side panel in closed position.

* * * * *

UNITED STATES PATENT AND TRADEMARK OFFICE

CERTIFICATE OF CORRECTION

PATENT NO. : 4,953,781

DATED : September 4, 1990

INVENTOR(S) : William T. Bryan

It is certified that error appears in the above-identified patent and that said Letters Patent is hereby corrected as shown below:

Col. 3, line 53, "slit" should be - - slits - -;

line 54, after "member" insert - - having - -;

Col. 4, line 64, at the end of the line after "to" insert - - the connecting panels, outer edges of the connecting panels being hinged to - -;

Col. 6, line 8, "draw" should be - - drawn - -;

line 46, after "claim" insert - - 16 - -;

Col. 7, line 12, after "pleat" insert - - panels - -;

Col. 8, line 12, before "face" insert - - inner - -.

Signed and Sealed this

Fourth Day of February, 1992

*Attest:*

HARRY F. MANBECK, JR.

*Attesting Officer*

*Commissioner of Patents and Trademarks*